United States Patent [19]

Sewell et al.

[11] Patent Number: 4,982,665

[45] Date of Patent: Jan. 8, 1991

[54] SHAPED CHARGE

[75] Inventors: Robert G. S. Sewell; John Pearson, both of China Lake, Calif.

[73] Assignee: The United States of America as represented by the Secretary of the Navy, Washington, D.C.

[21] Appl. No.: 421,365

[22] Filed: Nov. 29, 1973

[51] Int. Cl.[5] ..... F42B 12/10; F42B 1/02

[52] U.S. Cl. ..... 102/306; 102/476

[58] Field of Search ..... 102/20, 24 HC, 306–310, 102/476

[56] References Cited

U.S. PATENT DOCUMENTS

| | | | |
|---|---|---|---|
| 2,543,057 | 2/1951 | Porter | 102/24 HC |
| 3,157,124 | 11/1964 | Muller | 102/56 |
| 3,162,121 | 12/1964 | Crawford | 102/24 HC |
| 3,224,368 | 12/1965 | House | 102/24 HC |

FOREIGN PATENT DOCUMENTS

| | | | |
|---|---|---|---|
| 1175118 | 7/1964 | Fed. Rep. of Germany | 102/56 |
| 1946990 | 3/1971 | Fed. Rep. of Germany | 102/56 |
| 855932 | 12/1960 | United Kingdom | 102/56 |

*Primary Examiner*—Harold J. Tudor

*Attorney, Agent, or Firm*—Sol Sheinbein; Melvin J. Sliwka

[57] ABSTRACT

A shaped charge that relates generally to metal moving warheads and which has as an improvement a means of increasing the explosive energy in a metal moving warhead by providing an air gap between the explosive and the metal to be displaced thereby providing, upon detonation of the explosive charge, the formation of a high velocity jet of intensified energy that makes a superior shaped charge device for use in piercing or deforming solid material.

4 Claims, 1 Drawing Sheet

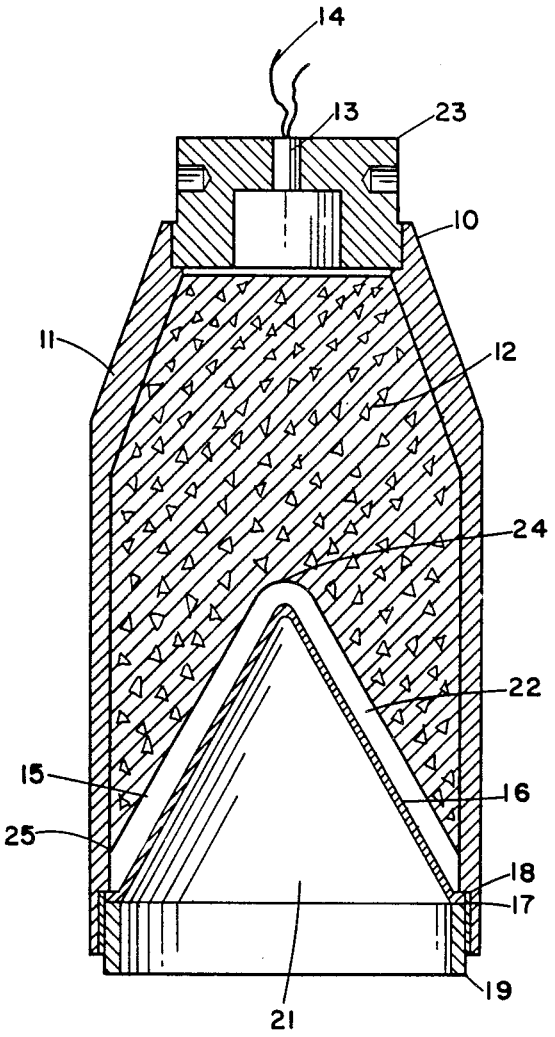
14
13
23
10
11
12
24
22
15
16
25
18
17
19
21

SHAPED CHARGE

BACKGROUND OF THE INVENTION

1. Field of Invention

This invention relates to an improved apparatus for a shaped charge.

2. Background of Invention

In the field of explosive devices, it has been the general practice to employ the use of hollow or shaped charges for cutting through or deforming solid material. These charges have wide use in military and non military applications, with the general shaped charge configuration of forming a cavity in the explosive being in use many years. This technique was found to be most effective when the cavity was formed in a conical or cup like shape in the face of the explosive charge. By forming the face of the explosive charge in a symmetrical manner about the axis of the explosive housing or container the explosive force can be controlled to move in a desired direction.

Further magnification of the explosive force can be made by the addition in the cavity of a metal liner. The metal liner is usually formed to have the same configuration as the cavity and is in intimate contact with it. Whenever the explosive charge is detonated a shock wave forms that collapses the liner axially and causes a transmission of energy to the liner causing the formation of a high velocity jet having an enormous amount of energy concentrated in a small area along the axis of the liner.

One of the most critical problems confronting designers of metal moving warheads utilizing an explosively shaped charge has been attempts at acoustic impedance matching by the use of different liner materials. Since each liner material bas a characteristic impedance that affects the propagation of the shock wave, it has been found desirable that the liner impedance be such that the greatest amount to energy is imparted to the liner by the shock wave in order to create the highest velocity jet from the liner material. This will result in an increase in the cutting action of the shaped charge. The disadvantage of impedance matching is that it necessarily requires a complex liner or liners attached to the face of the explosive cavity. These techniques increase the manufacturing costs of the shaped charge and at best only cause a marginal increase in jet velocity resulting in a somewhat better penetrating quality of the shaped charge.

SUMMARY OF THE INVENTION

An object of the invention is to provide an improved apparatus for a shaped charge that is of simple structure and more effective in penetrating, cutting or deforming solid material.

These and other objects herein after defined are met by the present invention which relates to an apparatus that improves the velocity of the jet produced by an explosive metal moving warhead. The explosive charge is contained in a cylindrical housing which has a closed end to contain the initiating charge and an open end in which a cone shaped or cup like cavity is formed in one face of the explosive charge. The vertex or apex of the cavity lies on the longitudinal axis of the explosive material end is positioned so as to be symmetrically disposed within the cylindrical housing. A malleable material forming a liner having a shape congruent with the formed cavity in the explosive charge is spaced a predetermined distance from the face of the explosive charge. The shaped liner is rigidly attached at its open end to the inner wall circumference of the cylindrical housing. This provides a space between the liner and explosive charge face that permits a means to allow a variation of the impedance of the liner by increasing or decreasing the air gap spacing, thus causing more energy to be transmitted to the malleable liner from the shock wave to provide a high velocity jet.

BRIEF DESCRIPTION OF THE DRAWING

The single FIGURE shows a longitudinal cross sectional view through the cylindrical shaped charge housing.

DESCRIPTION OF THE PREFERRED EMBODIMENT

Referring to the single drawing in the case in greater detail the FIGURE illustrates a generally explosive housing 10 that may be a projectile, a missile warhead or any explosive charge that is delivered by means not shown to the surface of the solid material to be penetrated. Housing 10 is closed at one end by means of a relatively thick walled end housing attached to housing 10 by threading or other known fastening means. Detonator housing 23 has a centrally bored hole for providing access of detonator device 13 to explosive charge 12 when the detonator 13 is electrically actuated by means of power to leads 14. Electrical initiation of detonator device 13 is shown for illustrative purposes only and many well known standard detonator devices could be used in its place.

Explosive housing 10 has relatively thickened walls 11 at the detonator end and has interior tapering walls extending from a predetermined distance above vertex 24 to detonator housing 23. This aids in confining the explosive force in this end of cylindrical housing 10. Housing 10 has a constant diameter portion extending from the tapered wall portion to its open end Explosive charge 12, filling the interior of housing 10, is formed at the open end of housing 10 with a conical shaped cavity having its vertex lying on and concentric with the center of cylindrical housing 10. The shaped cavity is symmetrical with the interior chamber of cylindrical housing 10 and formed to end at its largest diameter, shown as 25, a predetermined distance above the open end of housing 10.

A liner 16 of a malleable material, either metal or non metal, is formed to be congruent with the shape of the cavity in the explosive charge. In this embodiment tho liner 16 is formed from copper or aluminum but it could be formed from other metals, plastics or metal alloys. Liner 16 has at its largest diameter a flattened wall portion 17 that is rigidly locked in plate within the open explosive cavity by means of shoulder 18 formed in wall 11 and annular member 19. The member 19 is fastened to wall 11 by any suitable well known fastening means, not shown, such as threading, welding or the like. Liner 16 is spaced from explosive cavity surface 15 to form an air gap space or gaseous chamber 22. Chamber 22 is shown as filled with ambient air but it could be filled with an inert gas, low density foam or a honeycomb cellular material.

In operation the explosive shaped charge 12 is detonated by electrical initiation of detonator 13. This in turn ignites explosive charge 12 and causes a rapid detonation of the explosive starting from the closed end of housing 10 and proceeding toward the open end toward cavity 21. The shock wave caused by explosive 12 impinges on liner 16 causing energy to be absorbed in liner 16 as the shock wave propagates through it. The air gap 22 spacing between the explosive cavity surface 15 and the liner 16 provides a time delay that is adjusted to allow the maximum amount of energy to be absorbed by the liner form the created shock wave thus causing liner 16 to vaporize into a high velocity jet. The jet formed because of its high velocity will produce a deep penetration in solid material, The spacing of the air gap may be varied to achieve the maximum possible energy absorption by the particular liner material used in the shaped charge. Since many interacting factors affect the design of a particular shaped charge an optimum distance is chosen depending on the gas or material used in the air gap space and the design configuration of the shaped charge.

Although the preferred embodiment has been described, it will be understood that within the purview of this invention various charges may be made in the form, details, proportion and arrangement of parts, the combination thereof and mode of operation, which generally stated consist in a device capable of carrying out the objects set forth as disclosed and defined in the appended claims.

What is claimed is:

1. A shaped charge explosive device comprising:

a cylindrical housing open at one end having a central cavity for containing an explosive charge;

a detonatable explosive charge positioned within said cavity having formed at one end a symmetrical hollow cone shaped cavity that is positioned so its vertex lies on the longitudinal axis of said cylindrical housing and the surface of said cone shaped cavity intersects said cylindrical housing a predetermined distance from its open end;

a single cone shaped liner in juxaposition with said hollow cone shaped cavity formed in said explosive charge so as to be spaced a predetermined distance therefrom to form a continuous unbroken airgap layer, filled with an inert gas, between the exterior surface area of said cone shaped liner and the interior surface area of said cone shaped cavity formed in said detonatable explosive charge; and a detonating charge positioned concentric with said cylindrical housing and opposite its open end.

2. The shaped explosive charge device of claim 1 wherein the cone shaped liner is a malleable material.

3. The shaped explosive charge device of claim 2 wherein the malleable material is copper.

4. The shaped charge explosive device of claim 1 wherein said gap between said cone shaped liner and said explosive forms a thermal barrier for preventing heat conduction from the said housing to said explosive charge.

* * * * *